US011926397B2

(12) United States Patent
Wei et al.

(10) Patent No.: US 11,926,397 B2
(45) Date of Patent: Mar. 12, 2024

(54) UNDERWATER SWIMMING AID DEVICE

(71) Applicant: DEEPINFAR OCEAN TECHNOLOGY INC., Tianjin (CN)

(72) Inventors: Jiancang Wei, Teda (CN); Cheng Zhu, Teda (CN); Yubin Ma, Teda (CN)

(73) Assignee: DEEPINFAR OCEAN TECHNOLOGY INC., Tianjin (CN)

( * ) Notice: Subject to any disclaimer, the term of this patent is extended or adjusted under 35 U.S.C. 154(b) by 394 days.

(21) Appl. No.: 17/422,307

(22) PCT Filed: Jun. 11, 2020

(86) PCT No.: PCT/CN2020/095682
§ 371 (c)(1),
(2) Date: Jul. 12, 2021

(87) PCT Pub. No.: WO2021/063027
PCT Pub. Date: Apr. 8, 2021

(65) Prior Publication Data

US 2022/0081081 A1 Mar. 17, 2022

(30) Foreign Application Priority Data

Sep. 30, 2019 (CN) ..... 201921656298.6

(51) Int. Cl.
*B63C 11/02* (2006.01)
*B63C 11/46* (2006.01)

(52) U.S. Cl.
CPC ..... *B63C 11/02* (2013.01); *B63C 11/46* (2013.01); *B63C 2011/028* (2013.01)

(58) Field of Classification Search
CPC .... B63C 11/02; B63C 11/46; B63C 2011/028
See application file for complete search history.

(56) References Cited

U.S. PATENT DOCUMENTS 3,823,980 A * 7/1974 Harnick ..... A47C 7/185
297/452.59
4,611,264 A * 9/1986 Bradley ..... F21S 8/035
362/183

(Continued)

FOREIGN PATENT DOCUMENTS

CN 206900616 U 1/2018
CN 108063849 A 5/2018

(Continued)

OTHER PUBLICATIONS

Office Action dated Apr. 11, 2023, in corresponding Japanese Application No. 2021555387, 8 pages.

(Continued)

*Primary Examiner* — Stephen P Avila
(74) *Attorney, Agent, or Firm* — Maier & Maier, PLLC

(57) ABSTRACT

An underwater swimming aid includes a power device and a camera instrument fixing device, and the power device includes a propeller for providing power to drive the underwater swimming aid to advance and a connecting plate fixed to the propeller; and the camera instrument fixing device includes a mounting bracket and a fixing bracket, the mounting bracket is fixed to the connecting plate and is fixedly connected to the fixing bracket, and the fixing bracket is used for fixing a camera instrument. According to the underwater swimming aid, the camera instrument fixing device is fixed to an existing underwater swimming aid, and the camera instrument is mounted on the camera instrument fixing device, so that users can photograph underwater scenes while enjoying funs brought by the swimming aid.

6 Claims, 4 Drawing Sheets

(56) References Cited

U.S. PATENT DOCUMENTS

| | | | |
|---|---|---|---|
| 5,142,299 | A | 8/1992 | Braun |
| 2013/0343743 | A1 | 12/2013 | Yen |
| 2017/0108759 | A1 | 4/2017 | Clearman |

FOREIGN PATENT DOCUMENTS

| | | | |
|---|---|---|---|
| CN | 108128428 | A | 6/2018 |
| CN | 108382546 | A | 8/2018 |
| CN | 108945353 | A | 12/2018 |
| CN | 109501981 | A | 3/2019 |
| CN | 208890486 | U | 5/2019 |
| FR | 2914196 | A1 | 10/2008 |
| FR | 2915172 | A1 | 10/2008 |
| FR | 2964361 | A1 | 3/2012 |
| KR | 20140136278 | A | 11/2014 |
| WO | 2012/153036 | A1 | 11/2012 |

OTHER PUBLICATIONS

International Search Report dated Sep. 9, 2020 in corresponding International Application No. PCT/CN2020/095682; 6 pages.
Notice of Reasons for Refusal dated Oct. 4, 2022, in connection with corresponding Japanese Application No. 2021-555387; 10 pages (including with English Translation).
European Search Report dated Aug. 8, 2022, in connection with corresponding European Application No. 20871821.3; 6 pages.

* cited by examiner

UNDERWATER SWIMMING AID DEVICE

TECHNICAL FIELD

The present application mainly relates to the field of underwater swimming aids, in particular to an underwater swimming aid capable of fixing a camera instrument.

BACKGROUND

With the rise of underwater entertainment industries, the under equipment market in China is being gradually developed. Swimming aids, as underwater propulsion equipment for assisting users in swimming in water, adopt a motor to generate power to drive blades and typically include single-thrust swimming aids, dual-thrust swimming aids and multi-thrust swimming aids. The number of thrusts principally depends on the number of propellers.

The underwater swimming aids may be applied in different forms such as handheld type, foot-wear type and backpack type. For example, regarding a dual-thrust handheld swimming aid, a connecting plate is disposed between two propellers to be held by users. During use, the users may hold the connecting plate with both hands to swim more smoothly. The foot-wear swimming aid is worn on the feet during use and can bring different entertainment experiences to users.

However, if users want to record submarine scenes when playing under the sea with the underwater swimming aids, they have to hold a waterproof camera instrument by hand to photograph the submarine scenes in the swimming process, and thus cannot devote themselves to enjoying or photographing the scenes. When handheld underwater swimming aids are used, the life safety of users may be endangered.

SUMMARY

In view of this, the present application provides an underwater swimming aid, comprising a power device and a camera instrument fixing device, wherein the power device comprises a propeller for providing propulsion power and a connecting plate fixed to the propeller; and the camera instrument fixing device comprises a mounting bracket and a fixing bracket, the mounting bracket is fixed to the connecting plate, and the fixing bracket is fixedly connected to the mounting bracket and is used for fixing a camera instrument.

According to one implementation of the present application, the fixing bracket is rotatably connected to the mounting bracket.

According to one implementation of the present application, the camera instrument fixing device further comprises a fixing shaft, the mounting bracket has a first shaft hole, and one end of the fixing shaft penetrates through the first shaft hole and is fixed with a nut.

According to one implementation of the present application, the fixing bracket has a second shaft hole, and the other end of the fixing shaft penetrates through the second shaft hole and is fixed to the fixing bracket, so that the fixing shaft is able to rotate around the mounting bracket.

According to one implementation of the present application, the connecting plate further comprises an additional plate, and the mounting bracket is fixed to the additional plate.

According to one implementation of the present application, the connecting plate has a first threaded hole, the mounting bracket has a second threaded hole, and the first threaded hole and the second threaded hole are fixedly connected through a screw.

According one implementation of the present application, the mounting bracket comprises an insertion tooth and hook teeth, and the hook teeth are provided with protrusions, are located on side edges of the insertion tooth, and are elastic.

According to one implementation of the present application, the connecting plate comprises a clamping plate with a hollow accommodating space, grooves are formed in side edges of the clamping plate, the accommodating space is used for accommodating the insertion tooth and the hook teeth, and the protrusions are clamped in the grooves.

According to the underwater swimming aid, the camera instrument fixing device is fixed to a traditional underwater swimming aid, and the waterproof camera instrument, such as a mobile phone with a waterproof film, or a tablet computer, is mounted on the camera instrument fixing device, so that users can enjoy swimming funs brought by the swimming aid and can also record underwater scenes.

BRIEF DESCRIPTION OF THE DRAWINGS

Specific implementations of the present application will be explained below in conjunction with the accompanying drawings. The drawings are provided in the specification for the sake of a further understanding of the present application and constitute one part of the present application. Illustrative embodiments of the present application and the description thereof are merely used to explain the present application, and should not be construed as inappropriate limitations of the present application.

FIG. 4-1 is a schematic diagram of a clamping plate on the camera instrument fixing device in Embodiment 1 of the present application.

FIG. 4-2 illustrates a top view and a front view of the clamping plate on the power device in Embodiment 1 of the present application.

DETAILED DESCRIPTION OF EMBODIMENTS

To gain a better understanding of the solutions and advantages of the present application, the specific implementations of the present application will be explained in further detail below in conjunction with the accompanying drawings and embodiments. Obviously, the specific implementations and embodiments described below are only for the purpose of explanation, and are not intended to limit the present application.

It should be understood that terms such as "length", "crosswise", "lengthwise", "upper", "lower", "front", "back", "left", "right", "horizontal", "top", "bottom", "inner" and "outer" in the description of the present application are used to indicate directional or positional relations on the basis of the drawings merely for the purpose of facilitating and simplifying the description, do not indicate or imply that a device or an element referred to must be in specific direction or be configured and operated in specific direction, and thus, should not be construed as limitations of the present application.

Embodiment 1

Figure 1:
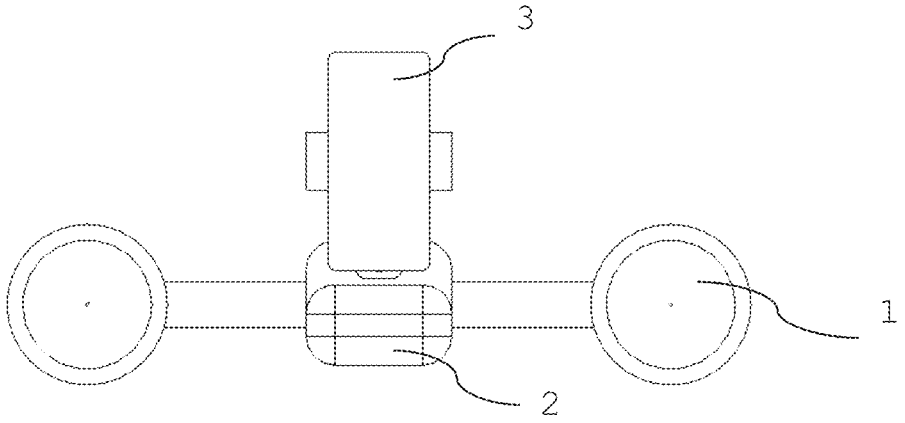
FIG. 1 is a front view of an underwater swimming aid in Embodiment 1 of the present application.
Figure 2:
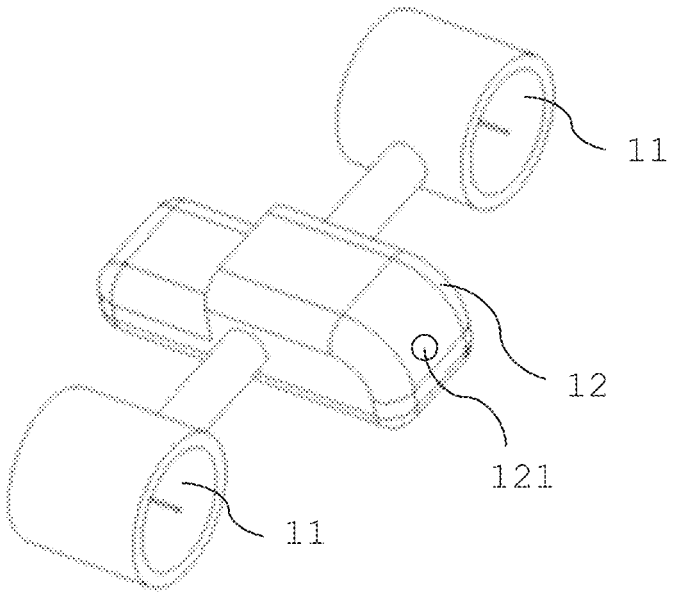
FIG. 2 is a schematic diagram of a power device in Embodiment 1 of the present application.
Figure 3:
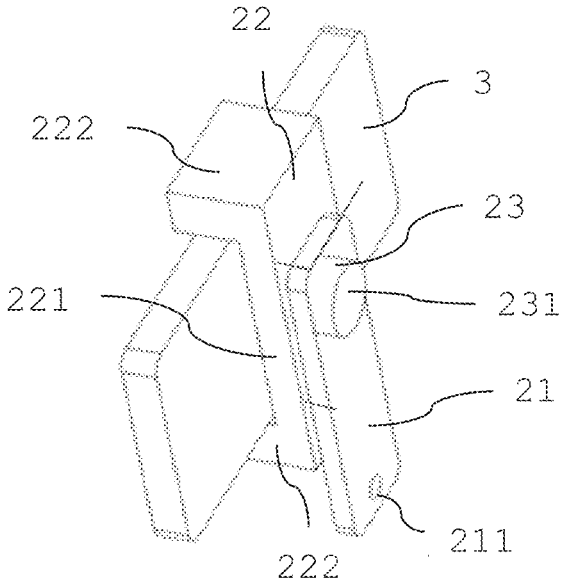
FIG. 3 is a schematic diagram of a camera instrument fixing device in Embodiment 1 of the present application.
Figures 1, 4:
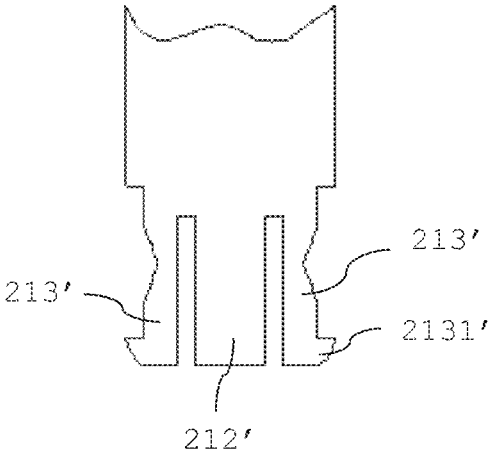
Figures 2, 4:
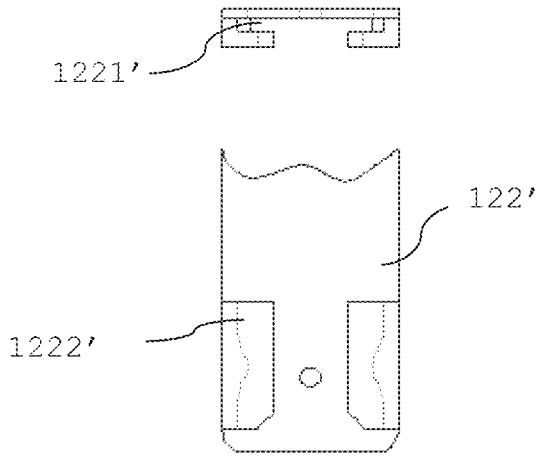

FIG. 1 is a schematic diagram of an underwater swimming aid in Embodiment 1 of the present application. FIG. 2 is a schematic diagram of a power device in Embodiment 1 of the present application. FIG. 3 is a schematic diagram of a camera instrument fixing device in Embodiment 1 of the present application. FIG. 4-1 is a schematic diagram of a clamping plate on the camera instrument fixing device in Embodiment 1 of the present application. FIG. 4-2 illustrates a top view and a front view of the clamping plate on the power device in Embodiment 1 of the present application.

As shown in FIG. 1, this embodiment discloses an underwater swimming aid comprising a power device 1 and a camera instrument fixing device 2. FIG. 1 also illustrates a camera instrument 3 fixed to the camera instrument fixing device 2.

As shown in FIG. 2, a dual-thrust handheld underwater swimming aid is described by way of example in this embodiment. The power device 1 may be an existing dual-thrust handheld underwater swimming aid and comprises propellers 11 and a connecting plate 12. The propellers 11 are located on two sides, and in this embodiment, the number of the propellers is two. The propellers 11 are connected through the connecting plate 12. A handle to be held by users may be arranged on the connecting plate 12. The connecting plate 12 has a first threaded hole 121 to be connected to the camera instrument fixing device 2.

In this embodiment, the first threaded hole 121 is formed in the middle of the front side of the connecting plate 12. Actually, the position of the first threaded hole 121 can be selected according to the actual condition and may be located on any one section of the connecting plate 12. Herein, the position of the first threaded hole 121 should not be construed as a limitation of this embodiment.

Furthermore, the dual-thrust underwater swimming aid is used as an example in this embodiment. Actually, a single-thrust swimming aid or a multi-thrust swimming aid such as a triple-thrust swimming aid, or a backpack or foot-wear underwater swimming aid may be adopted as long as a threaded hole is formed in the connecting plate 12 to realize connection with the camera instrument fixing device 2 to allow users to photograph underwater scenes by means of the camera instrument.

As shown in FIG. 3, the camera instrument fixing device 2 comprises a mounting bracket 21, a fixing bracket 22 and a fixing shaft 23.

As shown in FIG. 3, in this embodiment, the mounting bracket 21 is a vertical plate. A second threaded hole 211 is formed in the bottom of the mounting bracket 21, and a first shaft hole (not shown) is formed in the top of the mounting bracket 21 and is to be connected to the fixing bracket 22 for use. Actually, the specific shape and dimension of the mounting bracket can be adjusted as actually needed by the camera instrument and the connecting plate, and should not be construed as limitations of this embodiment. The second threaded hole 211 is connected to the first threaded hole 121 for use, and the specific position and dimension of the second threaded hole 211 should not be construed as limitations of this embodiment.

As shown in FIG. 3, the fixing bracket 22 has a ]-shaped cross-section and comprises a fixed block 221 and stretchable blocks 222. The number of the stretchable blocks 222 is two, and the two stretchable blocks 222 are located at two ends of the fixed block 221. The fixed block 221 has a hollow space allowing the stretchable blocks 222 to slide therein. The stretchable blocks 222 are provided with springs, and when the stretchable blocks are pulled out, the camera instrument is clamped by means of resilience force of the springs. The fixed block 221 has a second shaft hole (not shown) to be connected to the mounting bracket 21.

As shown in FIG. 3, the fixing shaft 23 includes one end 231 and the other end (not shown). The one end 231 is provided with a thread, penetrates through the first shaft hole, and is fixed with a nut (not shown). The other end penetrates through the second shaft hole and is fixed to the fixing bracket 22 with a countersunk nut. In this way, the fixing shaft 23 and the fixing bracket 22 can rotate around the mounting bracket 21.

As shown in FIG. 1, the first threaded hole 121 and the second threaded hole 211 are fixed together through a screw and a nut to fix the power device 1 and the camera instrument fixing device 2.

Actually, the clamping structure of the camera instrument can be in different forms, and the rotation structure of the fixing bracket 22 around the mounting bracket 21 can also be in different forms. Only simple and common ones are illustrated in this embodiment. Thus, the clamping structure of the camera instrument and the specific structure of the camera instrument fixing device should not be construed as limitations of this embodiment as long as the camera instrument can be fixed to the connecting plate 12 and can be clamped.

Furthermore, the power device 1 and the camera instrument fixing device 2 can be fixed in different manners. In this embodiment, the power device 1 and the camera instrument fixing device 2 are fixed with the screw. The connection manner of the power device 1 and the camera instrument fixing device 2 should not be construed as a limitation of this embodiment.

As shown FIG. 4-1 and FIG. 4-2, the power device 1 and the camera instrument fixing device 2 are connected and fixed in another manner, namely in a hook manner Specifically:

As shown in FIG. 4-1, an insertion tooth 212' and hook teeth 213' are fixed to the lower end of the mounting bracket 21'. In this embodiment, the number of the hook teeth 213' is two, and the two hook teeth 213' are located on side edges of the mounting bracket 21', are made of plastic, and are elastic. The hook teeth 213' are provided with outward protrusions 2131'. That is, the lower end of the mounting bracket 21' is approximately shape structure like Chinese character "山".

As shown in FIG. 4-2, a clamping plate 122' is fixed to an upper plane of the connecting plate 12', a hollow accommodating space 1221' is formed in the clamping plate 122', and inward grooves 1222'; are formed in side edges of the clamping plate 122'. When the hook teeth 213' and the insertion tooth 212' are inserted into the accommodating space 1221', the outward protrusions 2131' on the hook teeth 213' are clamped on the edges of the grooves 1222' to clamp and fix the mounting bracket 21'. The clamping plate 122' and the hook teeth 213' may be made of plastic. The hook teeth 213' can be slightly pressed inwards to be released.

When the underwater swimming aid in this embodiment operates, the propellers 11 on the power device 1 provide power to drive the underwater swimming aid A to advance so as to drive a user holding the swimming aid to swim forward. The waterproof camera instrument clamped on the camera instrument fixing device 2 can automatically photograph underwater scenes without being held by the user.

Embodiment 2

Figure 5:
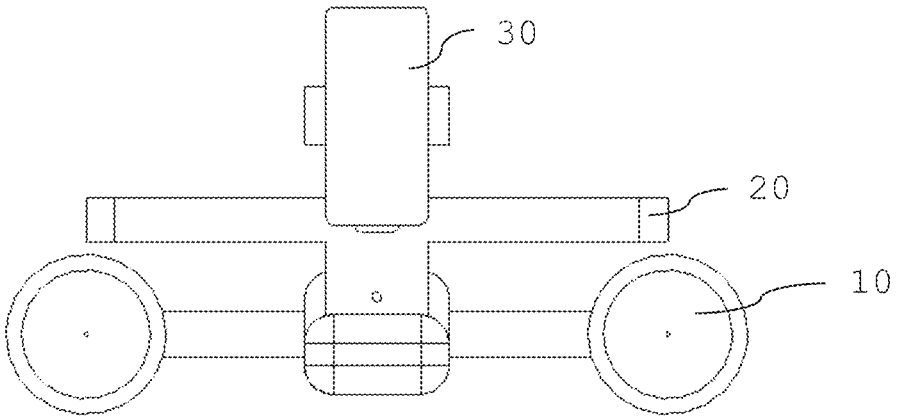
FIG. 5 is a front view of an underwater swimming aid in Embodiment 2 of the present application.
Figure 6:
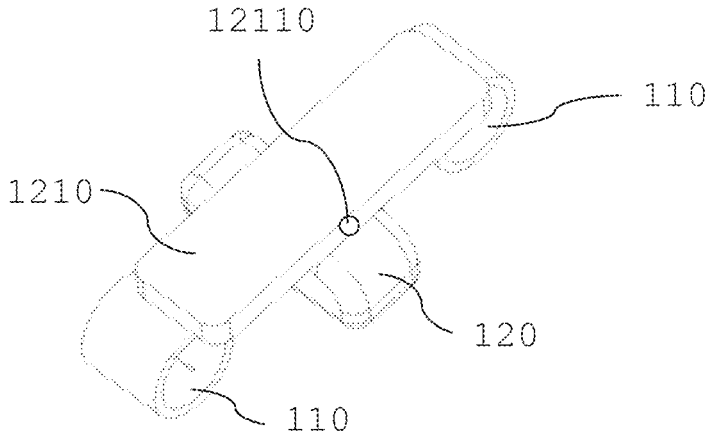
FIG. 6 is a schematic diagram of a power device in Embodiment 2 of the present application.
Figure 7:
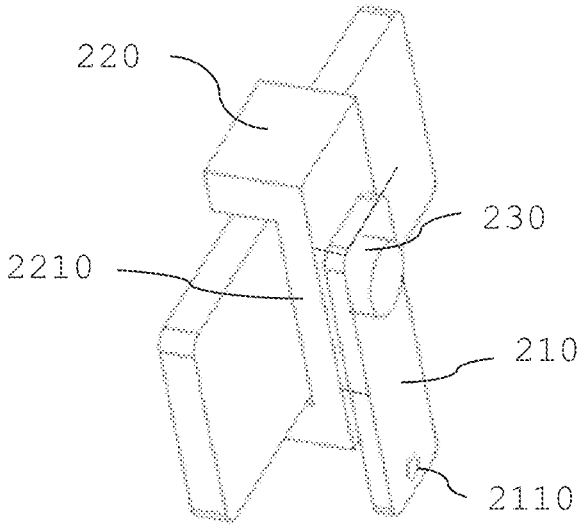
FIG. 7 is a schematic diagram of a camera instrument fixing device in Embodiment 2 of the present application.

FIG. 5 is a schematic diagram of an underwater swimming aid in Embodiment 2 of the present application. FIG. 6 is a schematic diagram of a power device in Embodiment 2 of the present application. FIG. 7 is a schematic diagram of a camera instrument fixing device in Embodiment 2 of the present application.

As shown in FIG. 5, this embodiment discloses an underwater swimming aid A comprising a power device 10 and a camera instrument fixing device 20. FIG. 5 also illustrates a camera instrument 30.

As shown in FIG. 6, a dual-thrust handheld underwater swimming aid provided with an additional plate is described by way of example in this embodiment. The power device 10 may be an existing dual-thrust handheld underwater swimming aid and comprises propellers 110 and a connecting plate 120. The propellers 110 are located on two sides and are connected through the connecting plate 120. A handle to be held by users and an additional plate 1210 may be disposed on the connecting plate 120. The additional plate 1210 is designed to make the power device 10 streamlined to reduce the resistance in water and can also be used for other purposes. The additional plate 1210 is fixedly mounted on the connecting plate 120 and has a third threaded hole 12110 to be connected to the camera instrument fixing device 20.

In this embodiment, the third threaded hole 12110 is formed in the middle of the front side of the connecting plate. Actually, the position of the third threaded hole 12110 can be selected according to the actual condition and may be located on any one section of the additional plate 1210. Herein, the position and dimension of the third threaded hole 12110 should not be construed as limitations of this embodiment.

Furthermore, the dual-thrust underwater swimming aid provided with the additional plate is used as example in this embodiment. Actually, a single-thrust swimming aid or a multi-thrust swimming aid such as a triple-thrust swimming aid, or a backpack or foot-wear underwater swimming aid may be adopted as long as a threaded hole is formed in the additional plate to realize connection with the camera instrument fixing device to allow users to photograph underwater scenes by means of the camera instrument.

As shown in FIG. 7, the camera instrument fixing device 20 comprises a mounting bracket 210, a fixing bracket 220 and a fixing shaft 230. The camera instrument fixing device 20 in this embodiment is identical in structure with the camera instrument fixing device 2 in Embodiment 1, and for the sake of brevity, only the differences therebetween will be described herein.

As shown in FIG. 7, in this embodiment, the mounting bracket 210 is a vertical plate. A fourth threaded hole 2110 is formed in the bottom of the mounting bracket 210, and a third shaft hole (not shown) is formed in the top of the mounting bracket 210 and is to be connected to the fixing bracket 220 for use. Actually, the specific shape and dimension of the mounting bracket can be adjusted as actually required by the camera instrument and the connecting plate, and should not be construed as limitations of this embodiment. The fourth threaded hole 2110 is to be connected to the third threaded hole 1210 for use, and the specific position and dimension of the fourth threaded hole 2110 should not be construed as limitations of this embodiment.

As shown in FIG. 7, the fixing bracket 220 in this embodiment is identical in structure with the fixing bracket 22 in Embodiment 1, and for the sake of brevity, will no longer be described herein.

The fixing shaft 230 in this embodiment is identical in structure with the fixing shaft 23 in Embodiment 1, and for the sake of brevity, will no longer be described herein.

As shown in FIG. 5, the third threaded hole 1210 and the fourth threaded hole 2110 are fixed together through a screw and a nut to fix the power device 10 and the camera instrument fixing device 20.

Actually, the clamping structure of the camera instrument can be in different forms, and the rotation structure of the fixing bracket 220 around the mounting bracket 210 can also be in different forms. Only simple and common ones are illustrated in this embodiment. Thus, the clamping structure of the camera instrument, more specifically the specific structure of the camera instrument fixing device, may be construed as a limitation of this embodiment as long as the camera instrument can be fixed to the additional plate 1210 and can be clamped.

Furthermore, the power device 10 and the camera instrument fixing device 20 can be fixed in different manners. In this embodiment, the power device 10 and the camera instrument fixing device 20 are fixed with the screw. The connection manner of the power device 10 and the camera instrument fixing device 20 should not be construed as a limitation of this embodiment.

When the underwater swimming aid in this embodiment operates, the propellers 110 on the power device 10 provide power to drive the underwater swimming aid to advance so as to drive a user holding the swimming aid to swim forward. The waterproof camera instrument clamped on the camera instrument fixing device 20 can automatically photograph underwater scenes without being held by the user.

Finally, it should be noted that the above embodiments are merely used to clearly explain the present application by way of examples, and are not intended to limit the implementations of the present application. Those ordinarily skilled in the art can obtain different variations or transformations on the basis of the aforesaid description. It is unnecessary and impossible to exhaust all implementations herein. All obvious variations or transformations obtained on the basis of the aforesaid description should also fall within the protection scope of the present application.

What is claimed is:

1. An underwater swimming aid, comprising:

a power device comprising a propeller for providing propulsion power and a connecting plate fixed to the propeller; and a camera instrument fixing device, comprising a mounting bracket and a fixing bracket, wherein the mounting bracket is fixed to the connecting plate, and the fixing bracket is fixedly connected to the mounting bracket and is used for fixing a camera instrument;

wherein the fixing bracket is rotatably connected to the mounting bracket, the camera instrument fixing device further comprises a fixing shaft, the mounting bracket has a first shaft hole, and one end of the fixing shaft penetrates through the first shaft hole and is fixed with a nut.

2. The underwater swimming aid according to claim 1, wherein the fixing bracket has a second shaft hole, and another end of the fixing shaft penetrates through the second shaft hole and is fixed to the fixing bracket, so that the fixing shaft can rotate around the mounting bracket.

3. The underwater swimming aid according to claim 1, wherein the connecting plate further comprises an additional plate, and the mounting bracket is fixed to the additional plate.

4. The underwater swimming aid according to claim 1, wherein the connecting plate has a first threaded hole, the mounting bracket has a second threaded hole, and the first threaded hole and the second threaded hole are fixedly connected by using a screw.

5. The underwater swimming aid according to claim 1, wherein the mounting bracket comprises an insertion tooth and hook teeth, and the hook teeth are provided with protrusions, are located on side edges of the insertion tooth, and are elastic.

6. The underwater swimming aid according to claim 5, wherein the connecting plate comprises a clamping plate with a hollow accommodating space, grooves are formed in side edges of the clamping plate, the hollow accommodating space is used for accommodating the insertion tooth and the hook teeth, and the grooves are used for clamping the protrusions.

* * * * *